US005632257A

United States Patent [19]

Machida et al.

[11] Patent Number: 5,632,257

[45] Date of Patent: May 27, 1997

[54] DIAGNOSIS APPARATUS AND METHOD FOR AN EXHAUST GAS RECIRCULATION UNIT OF AN INTERNAL COMBUSTION ENGINE

[75] Inventors: Kenichi Machida; Hirokazu Shimizu, both of Atsugi, Japan

[73] Assignee: Unisia Jecs Corporation, Kanagawa-ken, Japan

[21] Appl. No.: 603,146

[22] Filed: Feb. 20, 1996

[30] Foreign Application Priority Data

Feb. 20, 1995 [JP] Japan ..... 7-030857

[51] Int. Cl.[6] ..... F02M 25/07

[52] U.S. Cl. ..... 123/571; 73/117.3

[58] Field of Search ..... 123/568, 569, 123/571; 73/117.2, 117.3, 116, 118.2

[56] References Cited

U.S. PATENT DOCUMENTS

| | | | |
|---|---|---|---|
| 4,161,162 | 7/1979 | Latsch et al. | 123/571 |
| 4,314,534 | 2/1982 | Nakajima et al. | 123/571 |
| 4,433,667 | 2/1984 | Ripper | 123/571 |
| 4,624,229 | 11/1986 | Matekunas | 123/571 |
| 4,721,089 | 1/1988 | Currie et al. | 123/571 |
| 5,152,273 | 10/1992 | Ohuchi | 123/571 |
| 5,251,599 | 10/1993 | Ohuchi et al. | 123/571 |
| 5,257,610 | 11/1993 | Ohuchi | 123/571 |
| 5,265,575 | 11/1993 | Norota | 123/571 |
| 5,540,091 | 7/1996 | Nakagawa | 123/571 |

FOREIGN PATENT DOCUMENTS

| | | |
|---|---|---|
| 63-17432 | 2/1988 | Japan . |
| 6-288303 | 10/1994 | Japan . |

*Primary Examiner*—Willis R. Wolfe

*Attorney, Agent, or Firm*—Lowe, Price, LeBlanc & Becker

[57] ABSTRACT

A exhaust gas recirculation control value is forcibly open/close controlled at the time of steady operation. An estimation of whether or not the actual exhaust gas recirculation quantity has changed with open/close control of the exhaust gas recirculation control valve, is then made based on whether or not a change in combustion pressure accompanying the open/close is a value estimated for the operating conditions.

16 Claims, 5 Drawing Sheets

$$\Delta IMEP = \frac{(IMEP2 - IMEP1) + (IMEP2 - IMEP3)}{2}$$

DIAGNOSIS APPARATUS AND METHOD FOR AN EXHAUST GAS RECIRCULATION UNIT OF AN INTERNAL COMBUSTION ENGINE

FIELD OF THE INVENTION

The present invention relates to a diagnosis apparatus and method for an exhaust gas recirculation unit of an internal combustion engine, wherein a part of the engine exhaust gas is recirculated to the intake system. In particular the invention relates to technology for diagnosing if an exhaust gas recirculation unit is functioning normally, based on combustion pressure changes due to exhaust gas recirculation.

DESCRIPTION OF THE RELATED ART

Heretofore, as an apparatus for reducing NOx in the engine exhaust gas of an automotive internal combustion engine, there is known an exhaust gas recirculation unit which recirculates a portion of the engine exhaust gas back to the intake system to thereby lower the maximum combustion temperature and hence reduce NOx production.

With this unit it is desirable to provide an apparatus which can diagnose if normal exhaust gas recirculation is being carded out since if, due to a fault in the exhaust gas recirculation unit, normal exhaust gas recirculation cannot be carried out, then the NOx discharge quantity cannot be suppressed.

The present applicant observed the fluctuation characteristics of the output torque of an engine, resulting from the presence or absence of exhaust gas recirculation, and has previously proposed (refer to Japanese Unexamined Patent Publication No. 6-288303) an apparatus for carrying out fault diagnosis of an exhaust gas recirculation unit, based on fluctuations in combustion pressure when an exhaust gas recirculation control valve for adjusting the exhaust gas recirculation quantity is forcibly opened and closed.

With this diagnosis apparatus, the construction is such that the presence or absence of an abnormality is diagnosed by comparing the combustion pressure changes produced when the exhaust gas recirculation control valve is forcibly opened and closed, with a predetermined value. However, although the combustion pressure changes produced by opening and closing the exhaust gas recirculation control valve differ greatly with operating conditions, changing of the predetermined value in accordance with operating conditions is not carried out. Therefore, if an extreme abnormality occurs wherein under specific operating conditions, the exhaust gas recirculation control valve does not respond at all to the opening closing control, although the above mentioned apparatus carries out highly reliable diagnosis, it is not possible to respond to a requirement to widen the diagnosis region. Moreover, it is not possible to accurately diagnose a comparatively minor abnormality wherein the exhaust gas recirculation control valve sops at an intermediate opening during an opening/closing operation in response to the control.

SUMMARY OF THE INVENTION

The present invention takes into consideration the above problems, with the object of providing a diagnosis apparatus which can diagnose to good accuracy, abnormalities in the exhaust gas recirculation unit over a wide region, also covering comparatively minor faults.

Basically, it is an object of the invention, in carrying out diagnosis based on combustion pressure changes due to the presence or absence of exhaust gas recirculation, to be able to diagnose to high accuracy by judging the combustion pressure changes, based on an appropriate reference value.

Moreover, it is an object to be able to detect the combustion pressure changes to good accuracy.

To achieve the above objectives, the diagnosis apparatus and method according to the present invention for an exhaust gas recirculation unit of an internal combustion engine, wherein a portion of the engine exhaust gas is recirculated to the engine intake system via an exhaust gas recirculation passage in which is disposed an exhaust gas recirculation control valve, includes; computing a difference between a combustion pressure of the engine detected under open control conditions of the exhaust gas recirculation control valve, and a combustion pressure of the engine detected under close control conditions of the exhaust gas recirculation control valve, establishing an estimation value for the difference in accordance with operating conditions, and comparing the actual combustion pressure difference with the estimation value, to thereby diagnose the presence or absence of an abnormality.

With such a construction, diagnosis of whether or not the exhaust gas recirculation control valve actually shows an opening change matching the open/close control conditions is made by estimating the combustion pressure difference which is predicted to be produced by changes in the exhaust gas recirculation quantity, and comparing the estimated value with the actual computed difference.

Here the construction may be such that the engine cylinder pressure is integrated over a predetermined integration interval, and the cylinder pressure integral value is used as data indicating combustion pressure.

With such a construction, by using an integral value for the cylinder pressure rather than an instantaneous value for the combustion pressure, then deterioration in diagnosis accuracy due to the influence of noise and the like superimposed on the sensor signal can be avoided, so that combustion pressure changes due to changes in the exhaust gas recirculation quantity can be accurately obtained.

Furthermore, the construction may be such that the exhaust gas recirculation control valve is forcibly open/close controlled under steady operating conditions of the engine, and the difference between combustion pressures due to open/close control conditions is computed based on the combustion pressure change at the time.

With such a construction, diagnosis accuracy can be improved since under steady operating conditions of the engine, the combustion pressure is only influenced and changed by changes in the exhaust gas recirculation quantity. Moreover, by carrying out forcible open/close control, then opportunities for diagnosis can be reliably obtained.

Moreover, the construction may be such that the estimation value for the difference is established based on an exhaust gas recirculation proportion and the combustion pressure.

With such a construction, the estimation value can be established corresponding to differences in the combustion pressure changes due to differences in exhaust gas recirculation proportion. Moreover, the estimation value can be established corresponding to differences in combustion pressure changes due to differences in engine load estimated on the basis of combustion pressure.

Furthermore, the construction may be such that the presence or absence of an abnormality in the exhaust gas recirculation unit is judged based on a value of the actual combustion pressure difference divided by the estimation value.

With such a construction, by dividing the actual combustion pressure difference by the estimation value, then the difference can standardized. It can therefore be judged if an expected combustion pressure change has occurred, by comparing the division result with a fixed value.

Furthermore, the construction may be such that the presence or absence of an abnormality in the exhaust gas recirculation unit is judged based on a mean value of values for the actual combustion pressure difference divided by the estimation value.

With such a construction, by dividing the actual combustion pressure difference by the estimation value, then the difference can be standardized, and by obtaining a mean value of the division results, then diagnosis accuracy can be maintained in spite of variations in the combustion pressure changes.

Moreover, the construction my be such that the difference is computed based on combustion pressures detected after the lapse of a predetermined time from switching the open/close control of the exhaust gas recirculation control valve.

With such a construction, after switching the open/close control of the exhaust gas recirculation control valve, the combustion pressure difference due to a difference in the open/close control condition can be computed based on the combustion pressure which becomes a steady value matching the open/dose condition at the time. Therefore diagnosis accuracy can be ensured.

Furthermore, the construction my be such that mean value of, a change amount in the combustion pressure when the exhaust gas recirculation control valve is changed from en open control condition to at close control condition, and a change amount in the combustion pressure when the exhaust gas recirculation control valve is changed from close control condition to an open control condition, is computed as the combustion pressure difference due to open/close control conditions of the exhaust gas recirculation control valve.

With such a construction, variations in the difference due to the different control direction of the open/close control are cancelled, so that diagnosis is possible to good accuracy.

Other aspects and objects of the present invention will become apparent from the following description of embodiments given in conjunction with the appended drawings.

DETAILED DESCRIPTION OF A PREFERRED EMBODIMENT.

Figure 1:
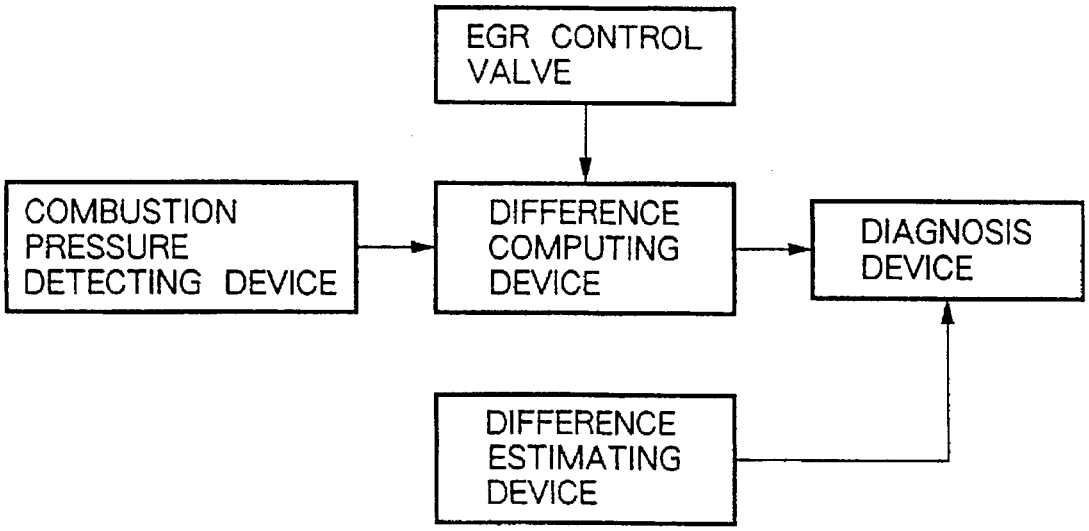
FIG. 1 is a block diagram of a basic configuration of a diagnosis apparatus according to the present invention.

FIG. 1 is a block diagram showing a basic configuration of a diagnosis apparatus according to the present invention, for an exhaust gas recirculation unit of an internal combustion engine. In FIG. 1 a combustion pressure detecting device detects combustion pressure of an engine while a difference computing device computes a difference between a combustion pressure detected under an open control condition of an exhaust gas recirculation control valve, and a combustion pressure detected under a close control condition of the exhaust gas recirculation control valve. On the other hand, a difference estimating device establishes an estimation value for the difference in accordance with operating conditions. A diagnosis device then judges the presence or absence of an abnormality in the exhaust gas recirculation unit based on a difference computed by the difference computing device and the estimation value estimated by the difference estimating device.

As follows is a description of an actual embodiment of a diagnosis apparatus and diagnosis method for an exhaust gas recirculation unit of an internal combustion engine having the above basic construction.

Figure 2:
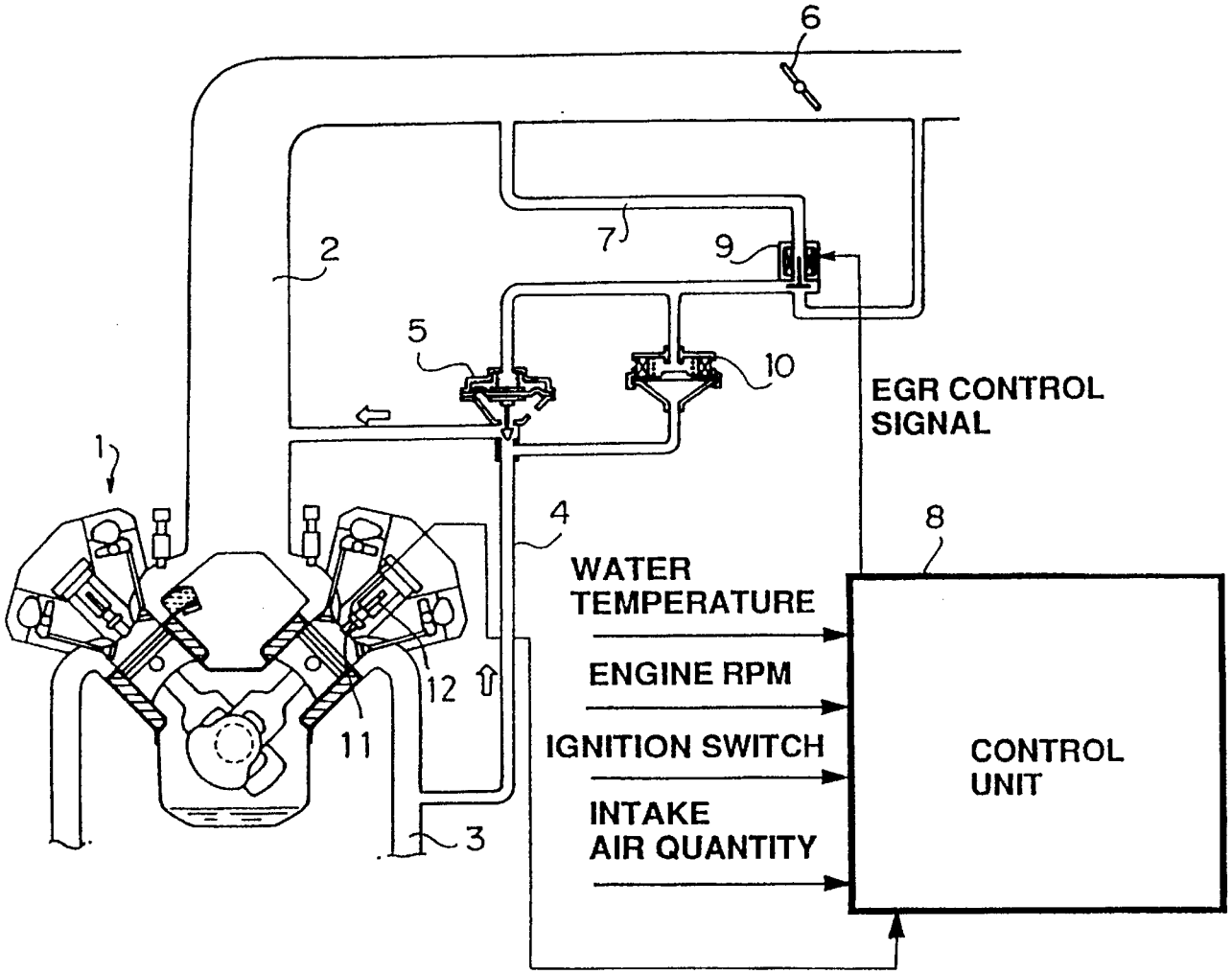
FIG. 2 is a schematic system diagram showing an embodiment of the present invention.

In FIG. 2 showing the system structure of the embodiment, an exhaust gas recirculation passage 4 is provided so as to communicate between an exhaust manifold 2 and an intake manifold 3 of an engine 1, and is opened and closed by means of an EGR control valve 5 (exhaust gas recirculation control valve).

The EGR control valve 5 is a diaphragm type valve which is opened by the action of a negative intake pressure of the engine resisting an urging force of a coil spring acting in a valve close direction. A negative pressure passage 7 is provided communicating between pressure chamber of the EGR control valve 5 and the intake manifold 3 downstream of a throttle valve 6. A negative intake pressure of the engine 1 is introduced to the pressure chamber via the negative pressure passage 7 to thereby open the EGR control valve 5.

An EGR control solenoid 9 which is on/off controlled by a control unit 8, is disposed in the negative pressure passage 7. The opening/closing of the EGR control valve 5, that is to say the switching control of the exhaust gas recirculation quantity is carried out by open/close control of the EGR control solenoid 9.

Numeral 10 denotes a diaphragm type BPT valve in which a diaphragm is operated by exhaust pressure and negative manifold pressure to set the negative pressure for controlling the EGR control valve 5.

Detection signals such as engine cooling water temperature, engine rotational speed, and engine intake air quantity from the respective sensors, together with an on/off signal from the ignition switch are input to the control unit 8, which then switches the EGR control solenoid 9 on and off based on engine operating conditions judged from these signals.

Also input to the control unit 8 are cylinder pressure detection signals from a cylinder pressure sensor 11 serving as a cylinder pressure detecting device. The cylinder pressure sensor 11 is of a type such as disclosed in Japanese Unexamined Utility Model Publication No. 63-17432 which is fitted as a washer for an ignition plug 12. However instead this type, a type wherein the sensor portion faces directly into the combustion chamber to detect the cylinder pressure as an absolute pressure may be used.

Figure 3:
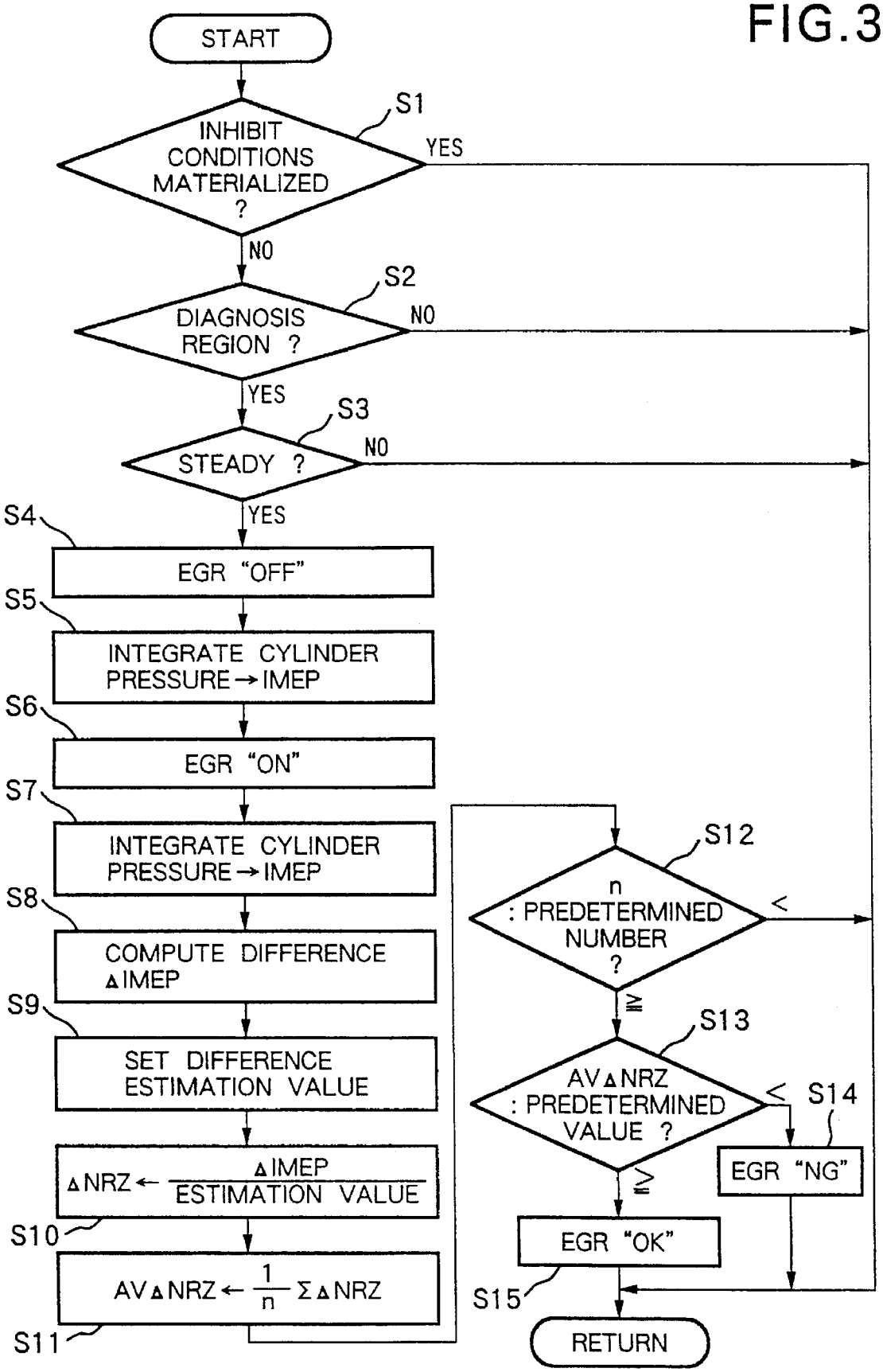
FIG. 3 is a flow chart showing a diagnosis control routine of the embodiment.

Here the control unit 8 has the function of carrying out diagnosis of the exhaust gas recirculation unit of the above-mentioned construction, as shown by the flow chart of FIG. 3, based on the cylinder pressure (combustion pressure) detected by the cylinder pressure sensor 11.

With the present embodiment, the functions of the combustion pressure detecting device, the difference computing device, the difference estimating device, and the diagnosis device (refer to FIG. 1 for these), as well as a cylinder pressure integrating device, and a forcible open/close device, are realized by software illustrated by the flow chart of FIG. 3 and stored in the control unit 8.

In the flow chart of FIG. 3, initially in step 1 (with "step" denoted by S in the figure), it is judged if diagnosis inhibit conditions have materialized.

Preferably a state where the cooling water temperature at start-up is less than a predetermined temperature and a period from a normal or abnormal judgment is made by the diagnosis control routine as illustrated below, until the ignition switch is switched off, are made the inhibit conditions.

If the inhibit condition has not materialized, control proceeds to step 2 where it is judged if conditions are relevant to a predetermined diagnosis region.

For the diagnosis region, the engine rpm, engine load, and cooling water temperature are respectively specified beforehand as operating conditions within a predetermined range.

If conditions are relevant to the diagnosis region, then in step 3, it is judged if the engine is at steady operating conditions. The steady conditions judgment is carried out based on whether or the engine rotational Speed, the engine load, and the time rates of change of the throttle valve opening, are within a predetermined range.

When judged to be steady, control proceeds to step 4 where the EGR control solenoid 9 is controlled so as to forcibly close the EGR control valve 5 and thus stop exhaust gas recirculation.

Then in step 5, the cylinder pressure integral value IMEP for the cylinder pressures detected by e cylinder pressure sensor 11 under exhaust gas recirculation stopped conditions and integrated over a predetermined integration interval is obtained as data representing combustion pressure. By integrating the cylinder pressures over a predetermined integration interval rather than using an instantaneous value for the cylinder pressure (combustion pressure), then combustion pressure changes due to influence from the exhaust gas recirculation can be obtained to a high accuracy without influence from noise and the like.

In the case wherein exhaust gas recirculation is forcibly stopped for diagnosis after having been carried out under normal control, then preferably the IMEP is computed once e predetermined time has elapsed from the stop control, and the exhaust gas recirculation stop conditions have become stable.

The integration interval may be made for example an interval from compression TDC to 100° ATDC approximately. Alternatively, an interval wherein combustion pressure changes due to the presence or absence of exhaust gas recirculation become particularly obvious may be obtained by prior experiment, and this interval set as the integration interval.

Once the cylinder pressure integral value IMEP has been obtained under exhaust gas recirculation stopped conditions, control proceeds to step 6 where the EGR control solenoid 9 is controlled so as to forcibly open the EGR control valve 5 and thereby effect exhaust gas recirculation.

Then in step 7 the cylinder pressure integral value IMEP is obtained during exhaust gas recirculation, in the same way as mentioned above.

In step 8, a difference ΔIMEP between cylinder pressure integral value obtained when the exhaust gas recirculation is stopped and the cylinder pressure integral value obtained during exhaust gas recirculation is computed. More specifically, since the combustion pressure should have dropped due to execution of the exhaust gas recirculation, then a difference matching the presence of absence of exhaust gas recirculation should also occur in the cylinder pressure integration value IMEP, due to the forcible open/close control of the EGR control valve 5. It is this difference which is obtained in step 8.

Figure 4:
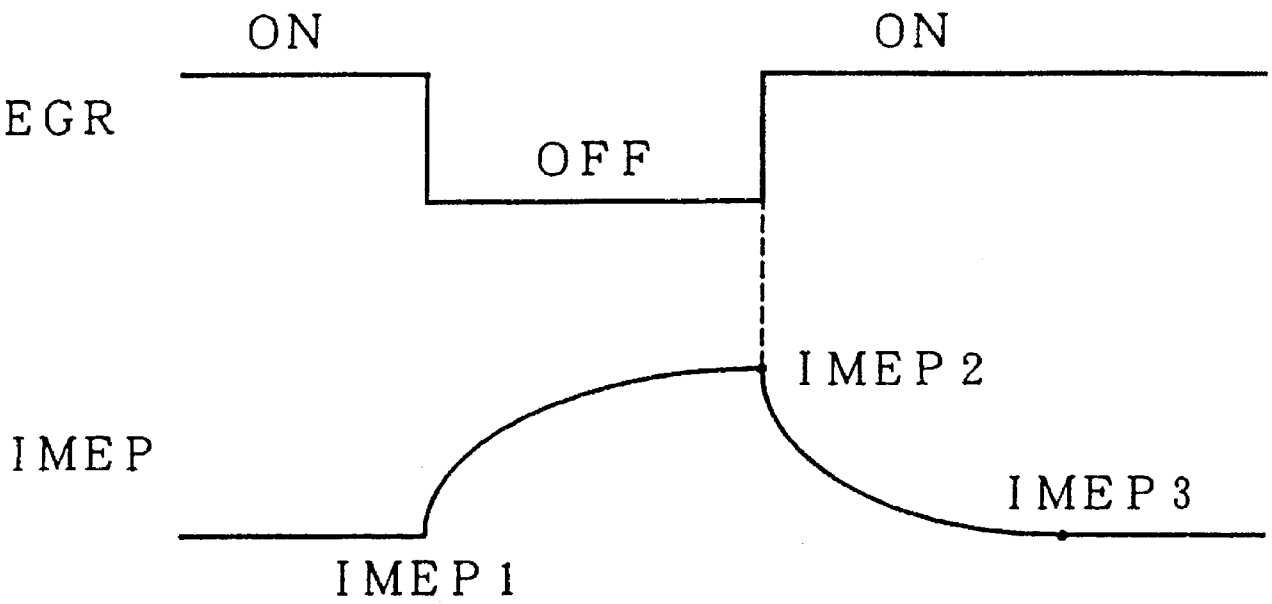
FIG. 4 is a time chart showing sampling timing for cylinder pressure integral values IMEP relative to exhaust gas recirculation control, in the embodiment.

In the computation of the difference ΔIMEP, this may be computed as shown in FIG. 4, using a cylinder pressure integral value IMEP1 for actual conditions of exhaust gas recirculation immediately prior to stopping exhaust gas recirculation, a cylinder pressure integral value IMEP2 for exhaust gas recirculation stopped conditions immediately prior to reopening exhaust gas recirculation after being forcibly stopped for a predetermined period, and a cylinder pressure integral value IMEP3 for a point in time wherein a predetermined time has elapsed after reopening exhaust gas recirculation, as $\Delta IMEP=\{(IMEP2-IMEP1)+(IMEP2-IMEP3)\}/2$. The mean value of, the combustion pressure changes accompanying opening to closing of the EGR control valve 5, and the combustion pressure changes accompanying closing to opening is thus the difference ΔIMEP.

Figure 5:
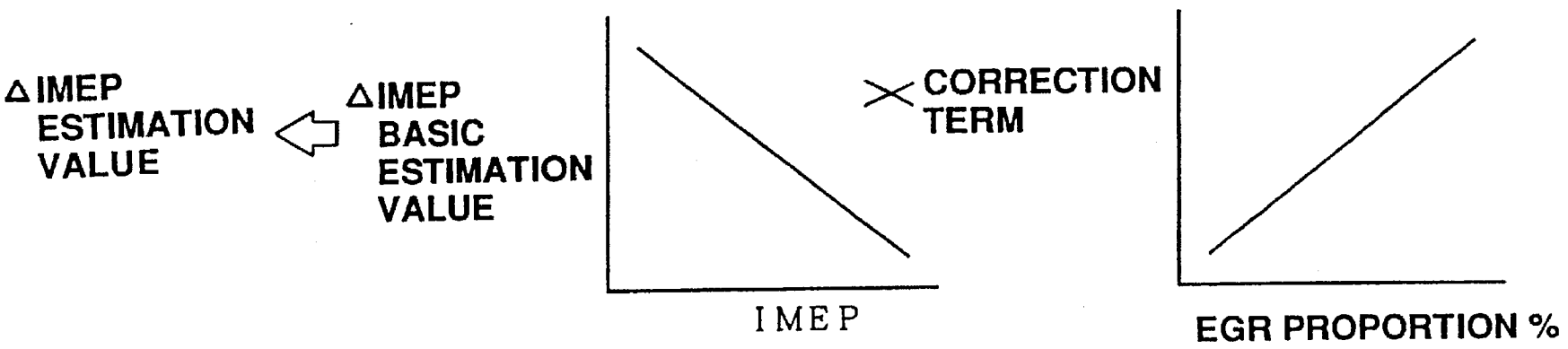
FIG. 5 is a graph showing the characteristic of estimation values for the cylinder pressure integral values IMEP in the embodiment.

Then in step 9, an estimation value for the difference ΔIMEP is obtained based on the cylinder pressure integral value IMEP obtained when exhaust gas recirculation is stopped, and an exhaust gas recirculation proportion. Since the larger the exhaust gas recirculation proportion, the larger the cylinder pressure integral value IMEP becomes due to the forcible open/close control of the EGR control valve 5, moreover if the cylinder pressure integral value IMEP (engine load) at the time is large, then the combustion pressure change due to the presence or absence of exhaust gas recirculation, in other words the difference ΔIMEP, will be small, even with the same exhaust gas recirculation proportion, then, corresponding to these characteristics, the difference ΔIMEP is estimated as shown in FIG. 5, based on the exhaust gas recirculation proportion and the cylinder pressure integral value IMEP obtained when exhaust gas recirculation is stopped.

In step 10, the actually produced difference ΔIMEP obtained in step 8 is divided by the estimation value obtained in step 9 to thereby standardize the difference ΔIMEP ($\Delta NRZ \rightarrow \Delta IMEP/\text{estimation value}$). By this standardization, then diagnosis can be carried out by treating the differences ΔIMEP computed under conditions wherein engine load and engine rotational speed and the like differ, with the same rank. As a result, diagnosis using a plurality of differences ΔIMEP can be easily carried out. Moreover, high accuracy diagnosis which includes differences in the difference ΔIMEP corresponding to operating conditions becomes possible.

The standardized difference ΔNRZ is then averaged in step 11, and the average value set to AVΔNRZ. By means of this averaging treatment, the influence of variations is avoided so that diagnosis accuracy is improved.

In step 12, it is judged if a sampling number n for the difference ΔNRZ in the averaging treatment in step 11 is equal to or above a predetermined number. If the sampling number n has not reached the predetermined number, then the current routine is terminated as is without making a diagnosis.

On the other hand, if the sampling number n is equal to or above the predetermined number, control proceeds to step 13 where the average value AVΔNRZ and a predetermined value (fixed value) set beforehand are compared. Here the average value AVΔNRZ is set as a value which is smaller when the combustion pressure changes due to forcibly opening and closing the EGR control valve 5 are smaller. A small combustion pressure change indirectly shows that changes in the exhaust gas recirculation quantity matching the forcible open/close control have not actually occurred.

Accordingly, when judged in step 13 that the average value AVΔNRZ is less than the predetermined value set beforehand, then it is considered that due to the occurrence of some fault in the exhaust gas recirculation unit (for example a blockage in the exhaust gas recirculation passage 4, or sticking of the EGR control valve 5 or the EGR control solenoid 9), changes in the exhaust gas recirculation quantity matching the forcible open/close control have not actually occurred, and control proceeds to step 14 where the occurrence of a fault in the exhaust gas recirculation unit is judged.

On the other hand, when judged in step 13 that the average value AVΔNRZ is equal to or more than the predetermined value set beforehand, then it is considered that changes in the exhaust gas recirculation quantity matching the forcible open/close control have actually occurred, and control proceeds to step 15 where it is judged if the normal exhaust gas recirculation unit is. The abovementioned judgment result may be notified to the driver by means of a display apparatus provided for example near the vehicle driver.

With the present embodiment, the construction includes a diaphragm type EGR control valve 5 disposed in the exhaust recirculation passage 4, and an EGR control solenoid 9 for controlling the introduction of negative engine intake pressure to the valve 5. However it will be clear that an exhaust gas recirculation unit constructed with a solenoid valve disposed dirty in the exhaust gas recirculation passage 4 is also possible.

When the EGR control valve 5 is forcibly open/close controlled for diagnosis, the opening of the EGR control valve 5 can be gradually changed in order to avoid the occurrence of sudden torque fluctuations accompanying sudden change in exhaust gas recirculation quantity.

We claim:

1. A diagnosis apparatus for an exhaust gas recirculation unit of an internal combustion engine wherein a portion of the engine exhaust gas is recirculated to the engine intake system via an exhaust gas recirculation passage in which is disposed an exhaust gas recirculation control valve, said apparatus comprising:

combustion pressure detecting means for detecting combustion pressure of the engine, difference computing means for computing a difference between a combustion pressure of the engine detected under an open control condition of said exhaust gas recirculation control valve, and a combustion pressure of the engine detected under a close control condition of said exhaust gas recirculation control valve, difference estimating means for establishing an estimation value for sad difference in accordance with operating conditions, and diagnosis means for judging the presence or absence of an abnormality in said exhaust gas recirculation unit based on said difference computed by said difference computing means and said estimation value established by said difference estimating means.

2. A diagnosis apparatus for an exhaust gas recirculation unit or an internal combustion engine according to claim 1, wherein said combustion pressure detecting means comprises;

cylinder pressure detecting means for detecting cylinder pressure of the engine, and cylinder pressure integrating means for integrating the cylinder pressure detected by said cylinder pressure detecting means, over a predetermined integration interval, and setting the cylinder pressure integral value as data indicating combustion pressure.

3. A diagnosis apparatus for an exhaust gas recirculation unit of an internal combustion engine according to claim 1, incorporating forcible open/close control means for forcible open/close control of said exhaust gas recirculation control valve under steady operating conditions of the engine, wherein said difference computing means computes a difference between combustion pressure when said exhaust gas recirculation control valve is forcibly opened by said forcible open/close control means, and a combustion pressure when said exhaust gas recirculation control valve is forcibly closed by said forcible open/close control means.

4. A diagnosis apparatus for an exhaust gas recirculation unit of an internal combustion engine according to claim 1, wherein said difference estimating means establishes the estimation value for said difference based on an exhaust gas recirculation proportion and said combustion pressure.

5. A diagnosis apparatus for an exhaust gas recirculation unit of an internal combustion engine according to claim 1, wherein said diagnosis means judges the presence or absence of an abnormality in the exhaust gas recirculation unit based on a value for the difference computed by said difference computing means divided by the estimation value established by said difference estimating means.

6. A diagnosis apparatus for an exhaust gas recirculation unit of an internal combustion engine according to claim 1, wherein said diagnosis means judges the presence or absence of an abnormality in the exhaust gas recirculation unit based on a mean value of values for the difference computed by said difference computing means divided by the estimation value established by said difference estimating means.

7. A diagnosis apparatus for an exhaust gas recirculation unit of an internal combustion engine according to claim 1, wherein said difference computing means computes said difference based on cylinder pressures detected by said combustion pressure detecting means after the lapse of a predetermined time from switching the open/close control of said exhaust gas recirculation control valve.

8. A diagnosis apparatus for an exhaust gas recirculation unit of an internal combustion engine according to claim 1, wherein said difference computing means computes a mean value of, a change amount in said combustion pressure when said exhaust gas recirculation control valve is changed from an open control condition to a close control condition, and a change amount in said combustion pressure when said exhaust gas recirculation control valve is changed from a close control condition to an open control condition, as the combustion pressure difference due to open/close control conditions of said exhaust gas recirculation control valve.

9. A diagnosis method for an exhaust gas recirculation unit of an internal combustion engine wherein a portion of the engine exhaust gas is recirculated to the engine intake system via an exhaust gas recirculation passage in which is disposed an exhaust gas recirculation control valve, said method including steps of; computing a difference between a combustion pressure of the engine detected under open control conditions of said exhaust gas recirculation control valve, and combustion pressure of the engine detected under close control conditions of said exhaust gas recirculation control valve, establishing an estimation value for said difference in accordance with operating conditions, and comparing the computed actual combustion pressure difference with said estimation value, to thereby judge the presence or absence of an abnormality in said exhaust gas recirculation unit.

10. A diagnosis method for an exhaust gas recirculation unit of an internal combustion engine according to claim 9, wherein the engine cylinder pressure is integrated over a predetermined integration interval, and the cylinder pressure integral value is used as data indicating combustion pressure.

11. A diagnosis method for an exhaust gas recirculation unit of an internal combustion engine according to claim 9, wherein said exhaust gas recirculation control valve is forcibly open/close controlled under steady operating conditions of the engine, and the difference between combustion pressures due to open/close control conditions of the exhaust gas recirculation control valve is computed based on the combustion pressure change at the time.

12. A diagnosis method for an exhaust gas recirculation unit of an internal combustion engine according to claim 9, wherein the estimation value for said difference is established based on an exhaust gas recirculation proportion and said combustion pressure.

13. A diagnosis method for an exhaust gas recirculation unit of an internal combustion engine according to claim 9, wherein the presence or absence of an abnormality in the exhaust gas recirculation unit is judged based on a value for said computed actual combustion pressure difference divided by said estimation value.

14. A diagnosis method for an exhaust gas recirculation unit of an internal combustion engine according to claim 9, wherein the presence or absence of an abnormality in the exhaust gas recirculation unit is judged based on a mean value of values for said computed actual combustion pressure difference divided by said estimation value.

15. A diagnosis method for an exhaust gas recirculation unit of an internal combustion engine according to claim 9, wherein said difference is computed based on cylinder pressures detected after the lapse of a predetermined time from switching the open/close control of said exhaust gas recirculation control valve.

16. A diagnosis method for an exhaust gas recirculation unit of an internal combustion engine according to claim 9, wherein a mean value of, a change amount in said combustion pressure when said exhaust gas recirculation control valve is changed from an open control condition to a close control condition, and a change amount in said combustion pressure when said exhaust gas recirculation control valve is charged from a close control condition to an open control condition, is computed as the combustion pressure difference due to open/close control conditions of said exhaust gas recirculation control valve.

* * * * *